US009147953B2

(12) United States Patent
Wehrle et al.

(10) Patent No.: US 9,147,953 B2
(45) Date of Patent: Sep. 29, 2015

(54) ELECTRICAL PLUG CONNECTOR FOR SOLDER-MOUNTING ON A CIRCUIT BOARD WITH TOLERANCE COMPENSATION

(71) Applicant: CONINVERS GmbH, Herrenberg (DE)

(72) Inventors: Gerhard Wehrle, Donaueschingen (DE); Holger Ritter, Wurmberg (DE)

(73) Assignee: CONINVERS GmbH, Herrenberg (DE)

( * ) Notice: Subject to any disclaimer, the term of this patent is extended or adjusted under 35 U.S.C. 154(b) by 153 days.

(21) Appl. No.: 13/927,469

(22) Filed: Jun. 26, 2013

(65) Prior Publication Data

US 2014/0024232 A1 Jan. 23, 2014

(30) Foreign Application Priority Data

Jul. 23, 2012 (EP) ..... 12401161

(51) Int. Cl.

| | |
|---|---|
| ***H01R 12/00*** | (2006.01) |
| ***H01R 12/71*** | (2011.01) |
| ***H01R 12/70*** | (2011.01) |
| ***H01R 12/91*** | (2011.01) |
| ***H01R 13/631*** | (2006.01) |

(Continued)

(52) U.S. Cl.

CPC ..... *H01R 12/712* (2013.01); *H01R 12/707* (2013.01); *H01R 12/91* (2013.01); *H01R 13/6315* (2013.01); *H01R 43/0256* (2013.01); *H01R 13/415* (2013.01); *H01R 43/16* (2013.01)

(58) Field of Classification Search

USPC ..... 439/83, 876, 252
IPC ..... H01R 12/57,23/725, 23/727, 13/6315, H01R 13/187; H05K 3/3405, 3/3426
See application file for complete search history.

(56) References Cited

U.S. PATENT DOCUMENTS 3,992,076 A * 11/1976 Gluntz ..... 439/853
4,666,227 A * 5/1987 Galizia et al. ..... 439/252

(Continued)

FOREIGN PATENT DOCUMENTS

EP 0 806 814 A1 11/1997
EP 1 434 313 A1 6/2004

(Continued)

OTHER PUBLICATIONS

European Search Report for corresponding European Application No. EP 12 40 1161 dated Dec. 10, 2012.

*Primary Examiner* — Hien Vu
(74) *Attorney, Agent, or Firm* — Renner, Otto, Boisselle & Sklar, LLP

(57) ABSTRACT

A plug connector for solder-mounting on a circuit board, comprising an insulating body and at least one oblong electrical plug contact held therein in a receptacle chamber, that extends between a foot part associated with a circuit board and a head part of the insulating body that faces the foot part at a distance. The at least one plug contact comprises at a front end that is close to the head part an accessible electrically contactable plug section, a central section adjacent to the plug section, and, adjacent to the central section, an exposed soldering section at a rear end that is close to the foot part. According to the invention, the central section comprises a rigid cylindrical holding zone adjacent to the plug section as well as a cylindrical flexible deformation zone extending between the holding zone and the soldering section, so that the plug section of the at least one plug connector can be shifted laterally in relation to the soldering section in case of a deformation of the deformation zone. Preferably, the deformation zone is made hollow and comprises a number of passages that permit a lateral deformation.

8 Claims, 7 Drawing Sheets

(51) Int. Cl.

| | |
|---|---|
| ***H01R 43/02*** | (2006.01) |
| *H01R 13/415* | (2006.01) |
| *H01R 43/16* | (2006.01) |

(56) References Cited

U.S. PATENT DOCUMENTS

| | | | | |
|---|---|---|---|---|
| 5,249,975 | A * | 10/1993 | Baderschneider et al. | 439/83 |
| 5,769,652 | A | 6/1998 | Wider | |
| 7,479,034 | B2 | 1/2009 | Blakborn et al. | |
| 2005/0037636 | A1 | 2/2005 | Lan | |
| 2010/0022105 | A1 | 1/2010 | Di Stefano | |

FOREIGN PATENT DOCUMENTS

| | | | |
|---|---|---|---|
| EP | 1 861 898 | A1 | 12/2007 |
| WO | WO 2006/100035 | A1 | 9/2006 |

* cited by examiner

ELECTRICAL PLUG CONNECTOR FOR SOLDER-MOUNTING ON A CIRCUIT BOARD WITH TOLERANCE COMPENSATION

CROSS-REFERENCE TO RELATED APPLICATION

The present application claims priority under 35 USC §119 to European Patent Application No. 12 401 161.0, filed Jul. 23, 2012, the entire disclosure of which is incorporated herein by reference.

TECHNICAL FIELD OF THE INVENTION

The invention relates to a plug connector for solder-mounting on a circuit board, comprising an insulating body and at least one oblong electrical plug contact held therein in a receptacle chamber, with said plug extending between a foot part associated with a circuit board and a head part of the insulating body that faces the foot part at a distance therefrom, and with the at least one plug contact, at a front end that is close to the head part, comprising an accessible electrically contactable plug section, a central section adjacent to the plug section, and, adjacent to the central section, an exposed soldering section at a rear end that is close to the foot part.

DESCRIPTION OF THE RELATED ART

Electrical plug connectors pose the problem of furnishing socket-and-pin-type plug connectors which can be plugged into each other and of which at least one plug connector is provided for soldering to a circuit board, and which, despite a certain misalignment of some or all socket or pin-type plug contacts, can be arranged without problems, after soldering to the circuit board, in a receptacle with tolerances. This problem will occur especially if the plug connector for solder-mounting on a circuit board that is to be soldered comprises a large number of plug contacts, or if several socket and/or pin-type plugs are arranged side-by-side on a circuit board, and if the electrical connection is to be established via a common group plug in a receptacle with tolerances. The displacement of the individual plug contacts, and therefore also that of the insulating bodies holding the plug contacts, is caused by manufacturing tolerances of the circuit board, of the electrical plug connectors, and of the process of soldering the socket or pin-type plug connectors to the circuit board. This problem is especially serious with electrical plug connectors for solder-mounting on a circuit board that are configured as surface-mountable components. If the position of the insulating body of such plug connectors does not precisely match the design position, problems may also occur when a housing part with the chambers or passages receiving the soldered plug connector(s) is to be fitted, enclosing and/or overlapping the associated insulating body.

In order to solve this problem, it is known from prior art to hold the plug contacts in floating condition in the associated insulating body. EP 1 861 898 A1 and EP 0 806 814 A1 are cited as examples. This, however, does not correct the misalignment of the plug contacts so that it is difficult to connect the matching contact parts of the matching plug connector with the plug contacts of the associated soldered plug connector for solder-mounting on a circuit board, with the soldered junctions of the plugs being subjected to high stress. Over the long term, this may damage the soldered junctions. In addition, the plug contacts of the at least one soldered plug connector for solder-mounting on a circuit board and/or the matching contact parts of the matching plug may be damaged or possibly even become unservicable.

With reference to the prior art referred to above, the invention addresses the problem of proposing a solution for a tolerance compensation between the plug contacts soldered to a circuit board of at least one plug connector for solder-mounting on a circuit board and a receptacle for the insulating body/bodies in which the metallic plug contact parts are held.

SUMMARY OF THE INVENTION

According to the invention, this problem is solved by an electrical plug connector for solder-mounting on a circuit board as described herein. Additional advantageous embodiments are also disclosed.

In the plug connector for solder-mounting on a circuit board referred to above, the plugging section is designed with a pin or a socket and the soldering area is designed for plug-in or surface mounting on the circuit board. According to the invention, the central section comprises a rigid cylindrical holding zone adjacent to the plug section as well as a cylindrical flexible deformation zone extending between the holding zone and the soldering section, so that the plug section of the at least one plug connector can be shifted laterally in relation to the soldering section in case of a deformation of the deformation zone. In the receptacle chamber, the plug section is guided via the holding zone and is therefore not affected during the deformation of the deformation zone that is easily possible due to the effect of a lateral force on the insulating body. After soldering to the circuit board, the soldering section is already fixed and stabilized on the circuit board via the soldering junction, and is therefore stable in terms of position and shape. Ideally, in relation to the holding zone of the central section and in relation to the soldering section, the deformation zone is designed geometrically in such a way that the deformation zone can essentially be laterally deformed in relation to these by a small force. This makes it possible to laterally shift the insulating body in relation to the circuit board in order to perform minor positional corrections during which the plug section of the at least one plug connector is not deformed.

Expediently, the deformation zone comprises locally defined sections in which the stability is reduced. Here, it is essential that these sections are designed and arranged in such a way that they permit, without problems, a lateral shift of the plug section relative to the soldering section in random directions parallel to the circuit board, without significant forces perpendicular and/or parallel to the circuit board occurring between the soldered junction and the holding zone of the plug contact. In this way, it is always possible to fit the insulating body into a receptacle in case of minor positioning errors, and it is always possible, at the head part of the insulating body of the plug connector for solder-mounting on a circuit board according to the invention, to connect a matching plug connector with matching plug contacts of complementary shape with the plug contacts of the plug section.

Preferably, the holding zone of the central section fixes the plug section of the at least one plug contact immovably, at least laterally, in the receptacle chamber, with an annular gap formed between the insulating body and the at least one plug contact in the area of the deformation zone in the receptacle chamber so that, when a lateral force is applied to the insulating body, the deformation zone can be deformed into the annular gap. Due to the annular gap, the deformation zone shows a lateral distance all around to the inner wall of the receptacle chamber, so that there the central section is bendable transversely to the longitudinal axis of the plug contact.

As a consequence, the associated wall of the receptacle chamber serves simultaneously as a stop for the deflection. It is also possible, however, to do without the individual walls of the receptacle chamber that surround the deformation zone of each plug contact. This is usually necessary especially with small plug connectors for solder-mounting on a circuit board due to a lack of space. The deformation zones of all plug contacts will then be only enclosed by a common wall that may extend up to the soldering area, and will form a common receptacle chamber section.

The holding zone of the central section that the plug section extends away from in the axial direction can be locked into the receptacle chamber, press-fitted into said chamber, molded into it, or can be attached there in some other way. Depending on how the plug contact is fixed in the receptacle chamber, the holding zone is anchored there more or less without play. Specifically, the plug contact can be guided in the receptacle chamber in the axial direction in a minimally movable way so that, in case of a deformation of the cylindrical flexible deformation zone, for example when the central section is bent laterally, the holding zone is able to shift minimally in relation to the receptacle chamber.

In a preferred embodiment of the invention, the at least one plug contact of the plug connector for solder-mounting on a circuit board according to the invention is designed to have a hollow interior at least in the area of the deformation zone. Due to the existing cavity that, advantageously, is also of cylindrical shape, the stability of the central section is distinctly weakened in the deformation zone, with the cavity possibly extending all the way into the soldering section. Preferably, the diameter of the cavity is dimensioned so that the deformation zone of the central section comprises, relative to the diameter of the central section, only one circumferential wall with a thickness that is low but sufficient for the amperage to be transmitted. This considerably facilitates the deformation of the deformation zone and therefore a lateral shift of the plug section relative to the soldering section.

In one embodiment of the invention, the deformation zone of the plug connector for solder-mounting on a circuit board comprises at least two passages that extend transversely and/or at an angle to the longitudinal axis of the at least one plug contact, that are staggered relative to each other in the axial direction, and that each extend in one plane across at least half of the circumferential wall of the deformation zone. The passages divide the deformation zone into individual deformation zone segments that are connected with each other and/or the adjacent holding zone with the adjacent plug section or with the soldering section only via a part of the circumferential wall of the central section. The connecting points of the deformation zone segments are those areas of the deformation zone that are especially flexible. They permit a lateral tilting of the deformation zone segments relative to each other, with the size of the passages decreasing and/or increasing. In this case, the deformation zone may comprise two or more passages that extend only transversely, only at an angle, or transversely and at an angle, with the planes in which each of the passages extends extending preferably at a random typical angle between 0 and 45° relative to each other and in relation to an orthogonal of the longitudinal axis of the plug contact.

In another embodiment of the plug connector for solder-mounting on a circuit board, the deformation zone comprises at least one passage that extends in spiral fashion in the longitudinal direction of the plug contact, preferably a spiral slot that extends across at least three fourths of the circumferential wall of the deformation zone in the circumferential and/or the axial direction. In the longitudinal direction of the plug contact, the at least one spiral-shaped passage extends preferably almost over the entire axial length of the deformation zone. In case of two or more of such passages, they are arranged in staggered fashion relative to each other in the circumferential direction as well as in the axial direction of the central section. In an especially favorable configuration, these passages are each arranged staggered relative to each other in a rotation-symmetrical fashion in the circumferential direction of the deformation zone so that none of the directions is favored or disfavored for the lateral shift. The spiral-shaped passages of the deformation zone act in the same way as the passages that extend each in one plane transversely and/or at an angle to the longitudinal axis of the plug contact.

In a preferred embodiment of the invention, the passages comprise transverse and/or angled slots as well as longitudinal slots that extend parallel to the longitudinal axis of the plug contact, and the transverse slots and/or the angled slots are connected at their ends with the longitudinal slots, and engage the longitudinal slots preferably in a central location. The additional longitudinal slots further weaken the rigidity of the deformation zone. Preferably, they are made significantly wider than the transverse and/or angled slots. This again significantly reduces the force required for the deformation of the deformation zone. It also makes it possible for the deformation zone segments that are formed by the at least two transverse and/or angled slots to be tilted relative to each other to a greater degree. The lateral shifting ability of the plug section relative to the soldering section is thereby increased.

Preferably, the longitudinal slots that are arranged in staggered fashion relative to each other and are connected with the ends of the transverse and/or angled slots are arranged one directly above the other. In all embodiments with at least two transverse and/or angled slots, it proved to be especially advantageous to arrange the passages staggered in rotation-symmetrical fashion relative to each other in the circumferential direction of the deformation zone, i.e. to distribute them evenly in the circumferential direction of the deformation zone. In the case of two transverse and/or angled slots, these are preferably arranged on the deformation zone staggered by 180° in relation to each other in the circumferential direction, and in the case of a different number of transverse and/or angled slots at an angle of 360°/number. This makes it possible to shift the plug section relative to the soldering section in all directions parallel to the circuit board to the same extent.

In all embodiments of the invention, when configured in a single-pole design, the proposed plug connector for solder-mounting on a circuit board may comprise a plug contact with a pin or socket-shaped plug section, and, when configured in a multi-pole design, may comprise a number of plug contacts with pin and/or socket-shaped plug sections arranged side-by-side. Here, the plug section, the holding zone, and the deformation zone of the central section and the soldering section of each plug contact may be of identical size and shape and/or of different size and shape. In all these embodiments, at least the central section with the deformation zone of the at least one plug contact comprises preferably plastically deformable material, with the plug connector for solder-mounting on a circuit board according to the invention being made of one or several pieces. In principle, the plug section and/or the soldering section may comprise a different material and be connected electrically and mechanically with the central section by means of common connecting methods known to a person skilled in the art. However, embodiments where the at least one plug contact is made of one piece are preferred.

In a multi-pole electrical plug connector for solder-mounting on a circuit board according to the invention, all plug contacts comprise a central section with a deformation zone with the characteristics referred to above. The plug contacts or the deformation zones are arranged relative to each other in such a way that they are not in each other's way during the alignment of the plug contacts and also do not make contact with each other. With single-pole as well as with multi-pole embodiments, the alignment of the plug contacts relative to each other and to the circuit board is performed indirectly via the alignment, relative to the circuit board, of the insulating body of the electrical plug connector for solder-mounting on a circuit board. Here, in the area of the deformation zone and/or in the soldering section, the insulating body may comprise dividing walls that keep the plug contacts reliably electrically separated from each other. The plug section is held electrically insulated in the receptacle chamber anyway. In order to prevent an undesirable deformation of the at least one plug contact during the alignment of the proposed plug connector for solder-mounting on a circuit board, and in order to prevent an unnecessary application of force to the soldering pins or soldering pads in question of the soldering section, the deformation zone preferably has a significantly lower rigidity than the holding zone of the central section or than the soldering section.

Specifically, the at least one plug contact of the plug connector for solder-mounting on a circuit board according to the invention is made as a milled part, a turned part, or a rolled stamped-and-bent part. Such parts can be produced cost-efficiently in conventional ways. In particular, with rolled stamped-and-bent plug contacts, the transverse, angled, longitudinal, or spiral slots can be installed prior to the rolling during the stamping process. Here, all types of geometries and types of arrangement are possible.

The electrical plug connector arrangement according to the invention comprises at least two electrical plug connectors for solder-mounting on a circuit board, according to one of the preceding claims, that are soldered to a circuit board. In a plug connector arrangement with at least two such plug connectors soldered to the circuit board, the tolerance compensation produced by the special design of the deformation zone of the central section is especially effective.

Below, the invention is explained in detail with reference to embodiments shown in the drawing. Additional characteristics of the invention are disclosed in the following description of the embodiment of the invention in conjunction with the claims and the attached drawing. The individual characteristics of the invention may be realized either individually by themselves or in combinations of several in different embodiments of the invention.

DETAILED DESCRIPTION OF THE INVENTION

Figure 1:
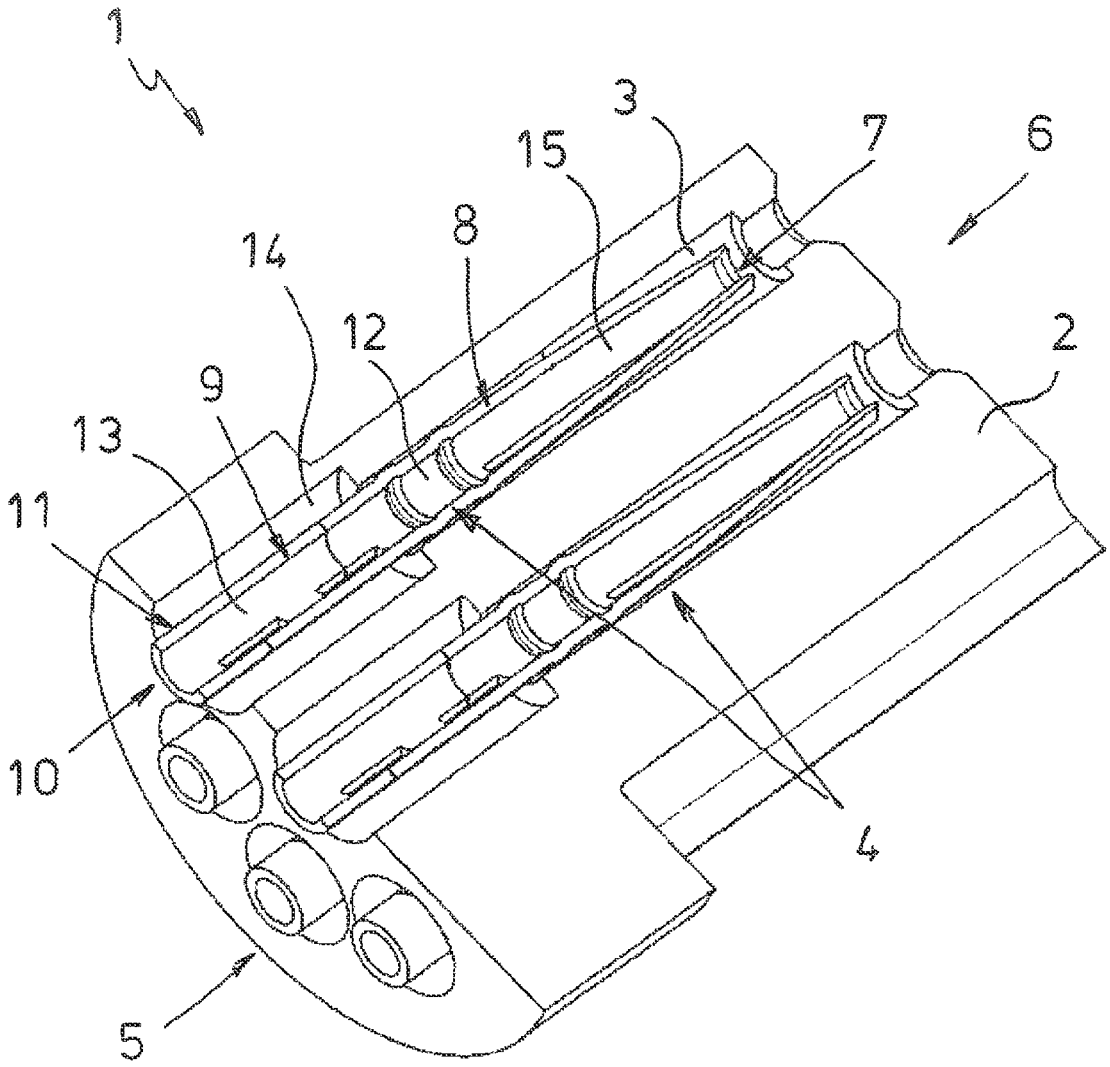
FIG. 1 shows a multi-pole plug connector for solder-mounting on a circuit board according to the invention in a perspective longitudinal section view.

As an example, FIG. 1 shows a multi-pole plug connector 1 for solder-mounting on a circuit board according to the invention for a circuit board (not shown) in a perspective longitudinal section view. The plug connector for solder-mounting on a circuit board 1 comprises an insulating body 2 and a number of oblong electrical plug contacts 4 held therein in receptacle chambers 3, with said plugs extending between a foot part 5 associated with the circuit board and a head part 6 of the insulating body 2 that faces the foot part 5 at a distance. The plug contacts 4 are of identical design and comprise, at a front end 7 that is close to the head part 6, an accessible electrically contactable plug section 8, a central section 9 adjacent to the plug section 8, and, adjacent to the central section 9, an exposed soldering section 11 at a rear end 10 that is close to the foot part 5. The central section 9 is divided into a rigid cylindrical holding zone 12 adjacent to the plug section 8 as well as a cylindrical flexible deformation zone 13 extending between the holding zone 12 and the soldering section 11. As a result, the plug section 8 of the associated plug contacts 4 can be shifted laterally in relation to the soldering section 11 in case of a deformation of the deformation zone 13, or the insulating body 2 can be shifted laterally in relation to the circuit board.

The holding zone 12 of the central section 9 fixes the plug section 8 of the plug contacts 4 laterally immovable in the receptacle chambers 3. Between the insulating body 2 and the associated plug contacts 4, one annular gap 14 each is formed in the area of the deformation zones 13 in the receptacle chambers 3 and/or below them. This makes it possible for the deformation zones 13 to deform into the annular gap 14 when a lateral force is applied to the insulating body 2. In the area of the deformation zone 13, the plug contacts 4 have a hollow interior and each comprise at the front ends 7 a plug section 8 with attached spring tabs 15. Preferably, rolled plug contacts 4 made as rolled stamped-and-bent parts are used for the plug connector 1 for solder-mounting on a circuit board according to the invention. All variants shown in the embodiments can also be made as turned parts. As examples, FIG. 2 shows in FIGS. 2*a* to 2*e* five different plug contacts 4 of this type, each shown in two views.

The embodiments of the plug contact 4 shown in the FIGS. 2*a* to 2*e* are first stamped from metal strip and then rolled. The plug contacts 4 are made as one piece of a plastically deformable material. The thickness of the strip of material used for this ranges typically between 0.25 and 0.4 mm. At an exemplary height of 5 mm and a corresponding diameter of approximately 1.5 mm of the deformation zone 13, the plug section 8 can be shifted laterally by approximately 0.35 mm in at least two directions in relation to the soldering section 11 by means of bending the deformation zone 13.

Figure 2A:
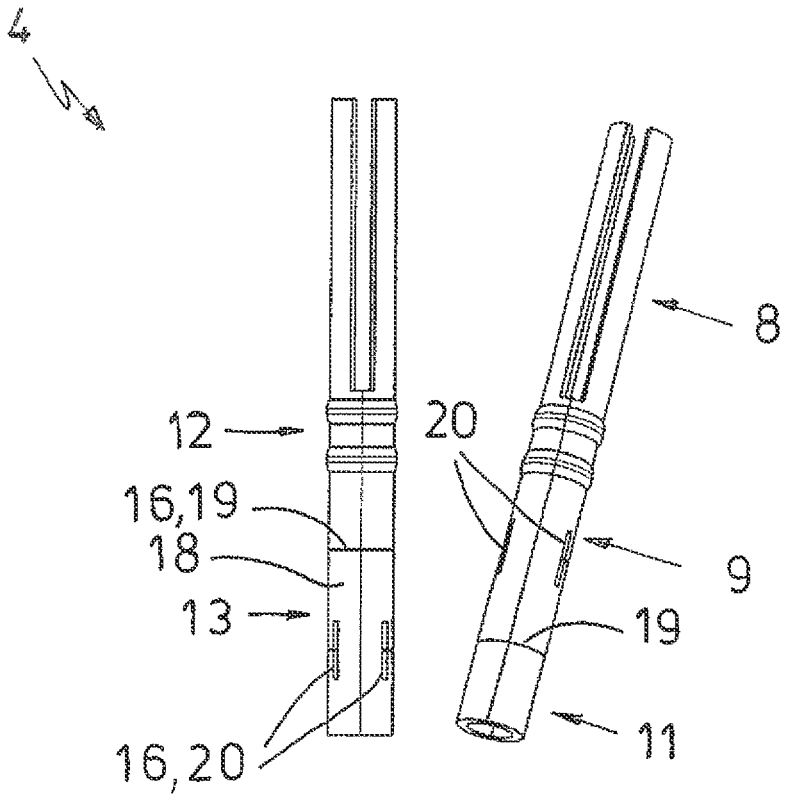
FIG. 2 shows various embodiments of electrical plug contact parts made as rolled stamped-and-bent parts (FIGS. 2*a* to 2*e*) of the plug connector for solder-mounting on a circuit board in FIG. 1, with a non-deformed deformation zone.
Figure 2B:
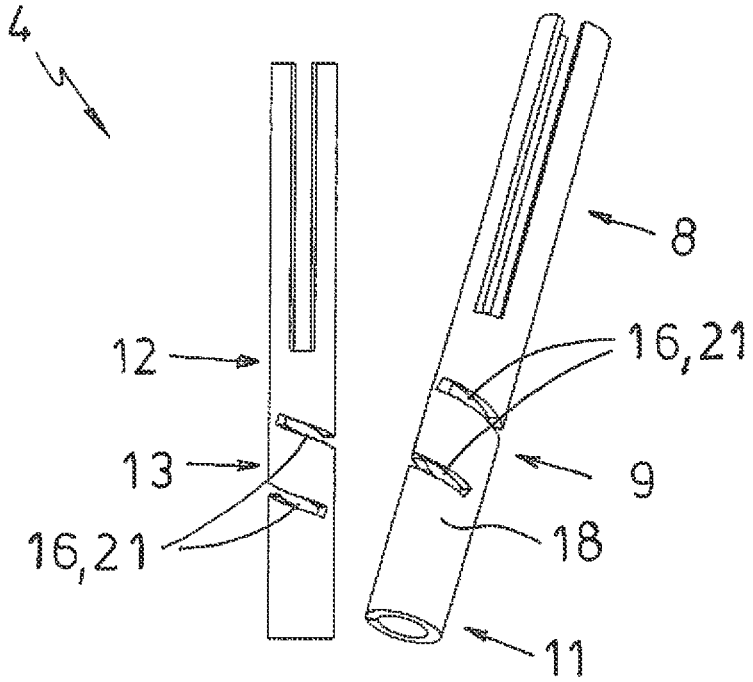
Figure 2C:
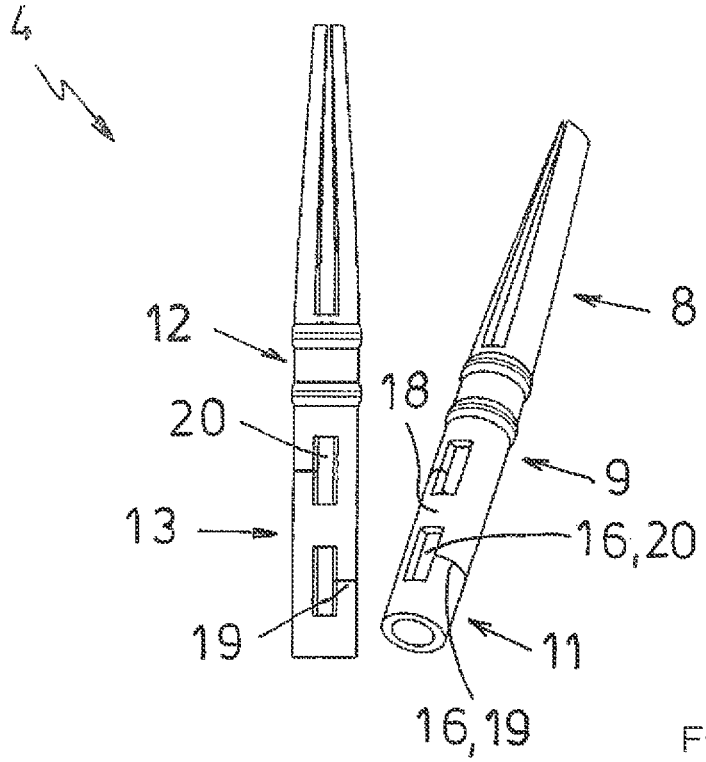

The variants of the plug contact 4 shown in the FIGS. 2*a*, 2*c* comprise a deformation zone 13 with two passages 16 that extend transversely to the longitudinal axis of the plug contact 4 and are staggered in the axial direction relative to each other. The passages 16 each extend in one plane beyond half of the circumferential wall 18 of the deformation zone 13. The passages 16 divide the deformation zone 13 into individual deformation zone segments 17 that are connected with each other only via a part of the circumferential wall 18 of the central section 9 and/or the holding zone 12 with the adjacent plug section 8 or with the soldering section 11. The deformation zone segments 17 are shown in the FIGS. 3, 4 with reference numbers. The connecting points of these deformation zone segments 17 are especially flexible. They permit a lateral tilting of the deformation zone segments relative to each other, with an ensuing change in the size and the shape of the passages 16.

In all plug contacts 4 with a tube-shaped deformation zone 13 shown in the FIGS. 2*a* to 2*c*, the passages 16 are formed as slots. Accordingly, the deformation zones 13 of the plug contacts 4 shown in the FIGS. 2*a*, 2*c* comprise transverse slots 19 that are staggered relative to each other in the axial direction of the central section 9. In these embodiments, in addition to the transverse slots 19, several longitudinal slots 20 are arranged that extend parallel to the longitudinal axis of the plug contact 4, with the transverse slots 19 being connected at their ends with the longitudinal slots 20 and engaging the longitudinal 20 in a central location. The longitudinal slots 20 are made significantly wider than the transverse slots 19. According to FIG. 2*a*, the two longitudinal slots 20 associated with the transverse slots 19 are arranged one above the other and staggered in the circumferential direction. In the embodiment shown in FIG. 2*c*, these longitudinal slots 20 are arranged one directly above the other.

FIG. 2*b* shows an embodiment of the plug contact 4 with a tube-shaped deformation zone 13 where the passages 16 of the deformation zone 13 comprise angled slots 21 instead of transverse slots 19. The angled slots 21 extend at an angle to the longitudinal axis of the plug contact 4. The two angled slots 21 are staggered relative to each other in the axial direction and extend in one plane across at least half of the circumferential wall 18 of the deformation zone 13. Although no longitudinal slots are provided in this embodiment, in principle it is nevertheless possible to include them.

Figure 2D:
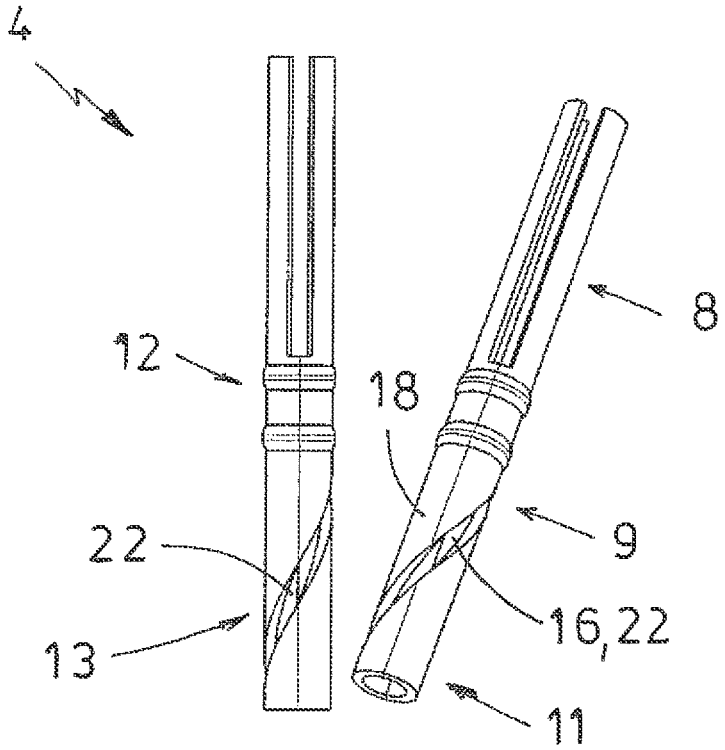
Figure 2E:
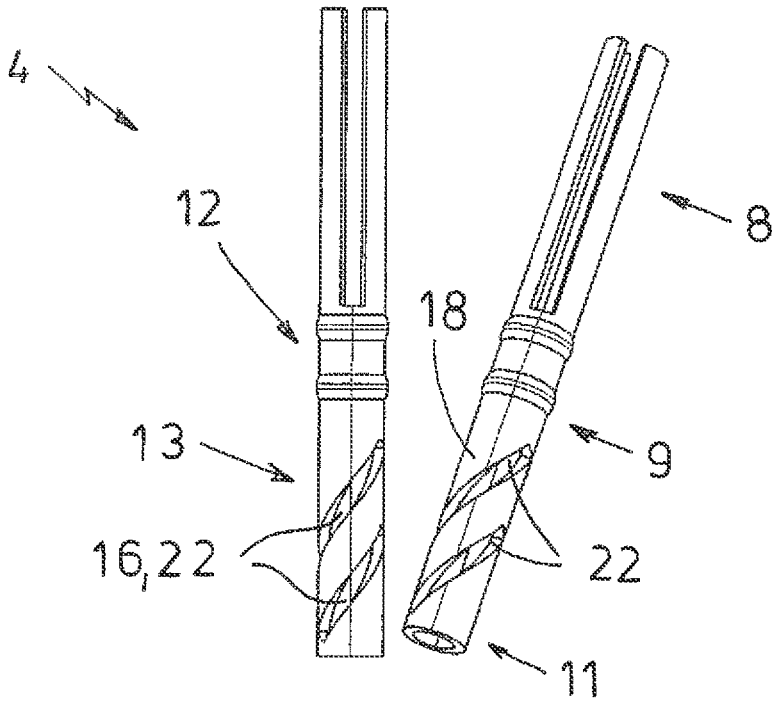
Figure 3A:
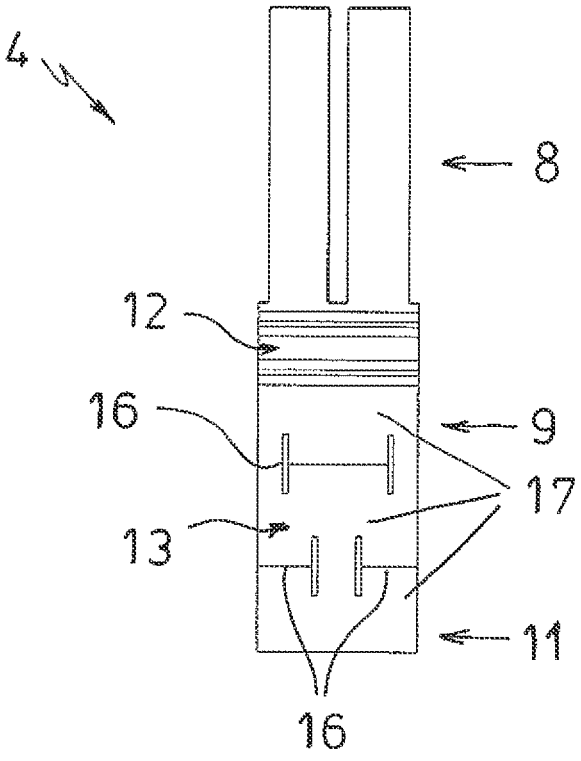
FIG. 3 shows the development of the plug contacts in FIG. 2 (FIGS. 3*a* to 3*e*)
Figure 3B:
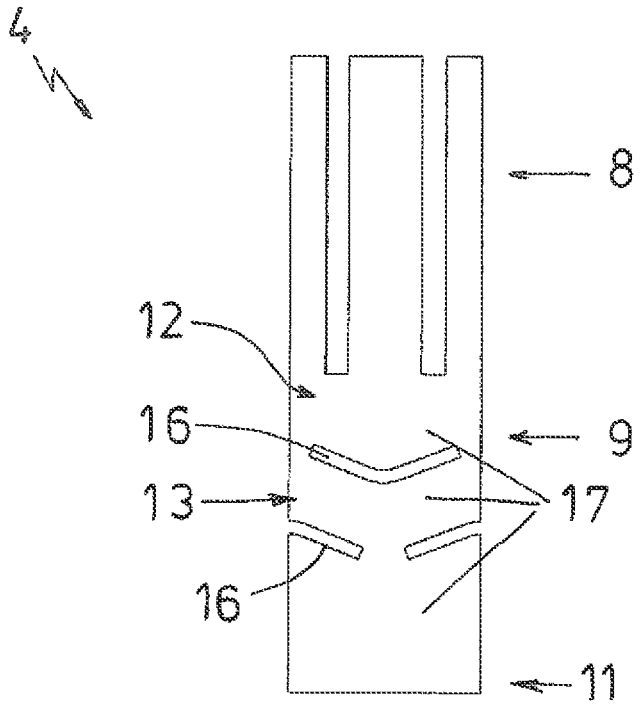
Figure 3C:
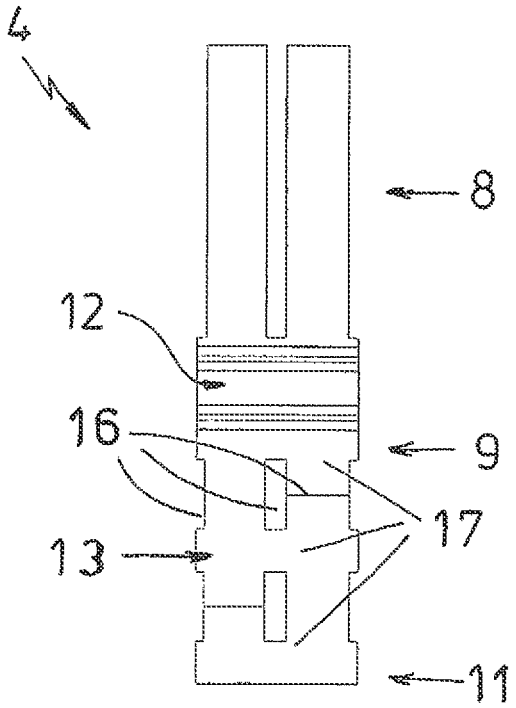
Figure 3D:
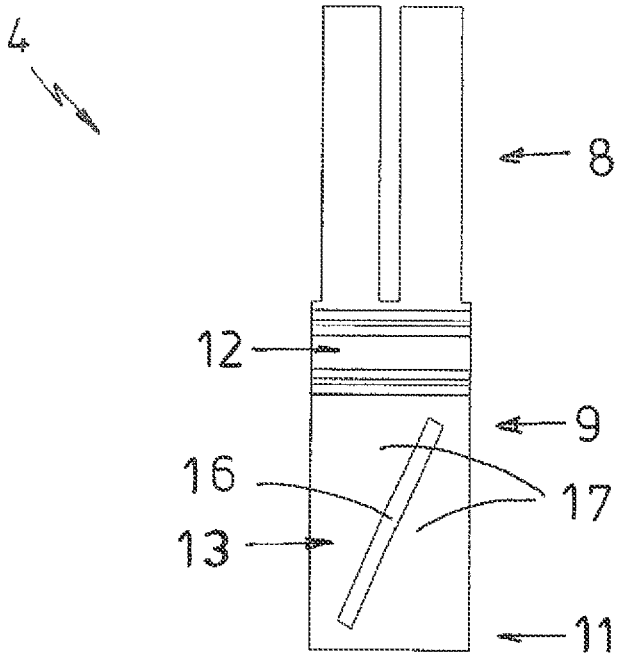
Figure 3E:
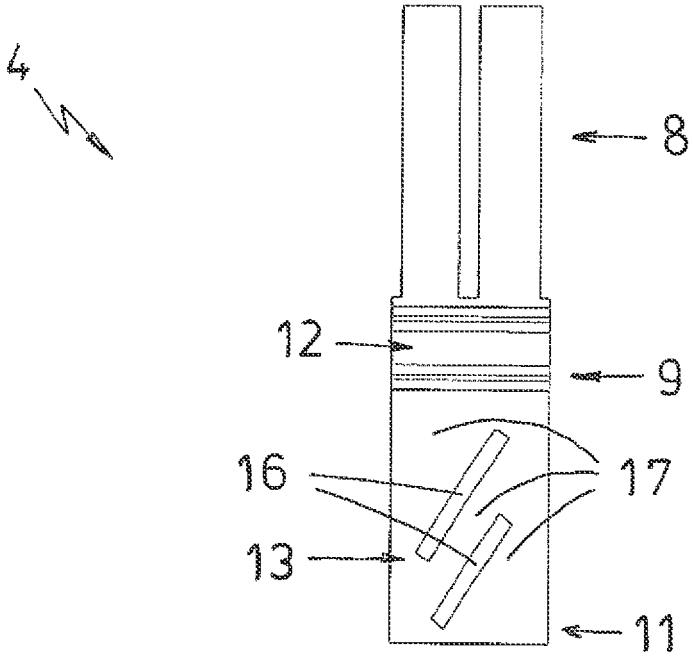

Instead of transverse slots 19 and/or angled slots 21, with or without longitudinal slots 20 connected thereto, the deformation zone 13 may also comprise at least one passage 16 that extends in a spiral form in the longitudinal direction of the plug contact 4, preferably a spiral slot 22 that extends over at least three fourths of the circumferential wall 18 of the deformation zone 13. In the longitudinal direction of the plug contact 4, the at least one spiral slot 22 extends preferably over almost the entire axial length of the deformation zone 13. FIG. 2*d* shows such an embodiment with a spiral slot 22, FIG. 2*e* show a variant thereof with two spiral slots 22. The spiral slots 22 formed by the spiral-shaped passages 16 each act in the same way as the transverse slots 19 or the angled slots 21. Advantageously, in all embodiments of the plug contacts 4 shown in FIG. 2, the passages 16, i.e. especially the transverse slots 19, the angled slots 21, or the spiral slots 22 are arranged, staggered relative to each other, rotation-symmetrically around the center axis of the deformation zone 13.

The FIGS. 3*a* to 3*e* show the development of the plug contacts 4 in FIGS. 2*a* to 2*e*. There, the size, shape, arrangement, and their extension in the deformation zone 13 of the passages 16 can be seen clearly. In addition, they show the positional and size relationships of the plug section 8, the central section 9, and the soldering section 11 relative to each other, and especially also those of the deformation zone 13.

Figure 4A:
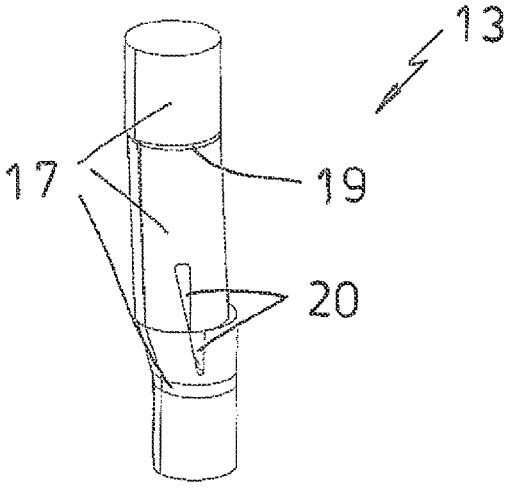
FIG. 4 shows enlarged details of the deformed deformation zone (FIGS. 4*a* to 4*c*) of the plug contacts according to FIGS. 2*a* to 2*c*.
Figure 4B:
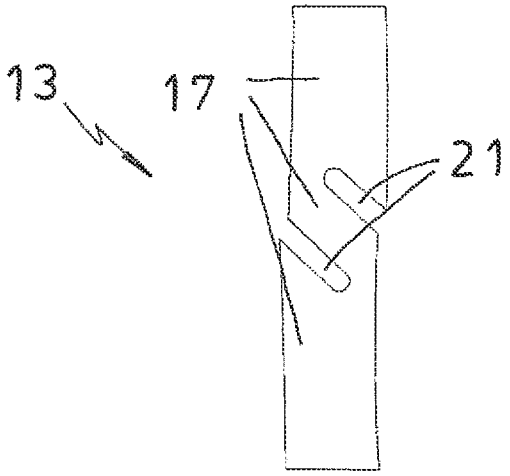
Figure 4C:
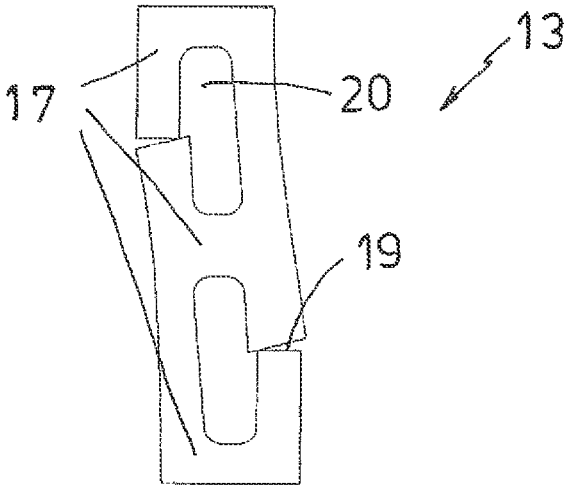

The FIGS. 4*a* to 4*c* show detail enlargements of a deformed deformation zone 13 of the plug contacts 4 according to the FIGS. 2*a* to 2*c*. Here, it can be seen clearly that the three deformation zone segments 17 are tilted relative to each other, with the two outer deformation zone segments 17 aligned parallel to each other. As a result, the plug section 8 shows a lateral shift in relation to the soldering section 11. It can be seen clearly that the passages 16 in the form of transverse slots 19, angled slots 21, and/or longitudinal slots 20 are distinctly changed in comparison with their original shape shown in the FIGS. 2 and 3.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

The invention claimed is:

1. A plug connector for solder-mounting on a circuit board, comprising an insulating body and at least one oblong electrical plug contact held therein in a receptacle chamber, with said plug connector extending between a foot part associated with a circuit board and a head part of the insulating body that faces the foot part at a distance, and with the at least one oblong electrical plug contact at a front end that is close to the head part, the at least one oblong electrical plug contact comprising an accessible electrically contactable plug section, a central section adjacent to the plug section, and , adjacent to the central section , an exposed soldering section at a rear end that is close to the foot part, wherein the central section comprises a rigid cylindrical holding zone adjacent to the plug section as well as a cylindrical flexible deformation zone extending between the holding zone and the soldering section so that the plug section of the at least one oblong electrical plug contact can be shifted laterally in relation to the soldering section when the deformation zone is deformed, wherein the at least one oblong electrical plug contact is made of one piece and has a hollow interior at least in the area of the deformation zone, and wherein the deformation zone comprises at least two transverse slots that extend transversely to the longitudinal axis of the at least one oblong electrical plug contact and are staggered relative to each other in the axial direction, and that each extends in one plane over at least half of the circumferential wall of the deformation zone, as well as longitudinal slots extending parallel to the longitudinal axis of the at least one oblong electrical plug contact, with the transverse slots being connected with the longitudinal slots at the ends and engaging the longitudinal slots preferably in a central location thereof, and wherein at least the deformation zone of the at least one oblong electrical plug contact comprises deformable material.

2. The plug connector for solder-mounting on a circuit board according to claim 1, wherein the holding zone of the central section fixes the plug section of the at least one oblong electrical plug contact at least laterally immovably in the receptacle chamber, and that in the area of the deformation zone, between the insulating body and the at least one plug contact, an annular gap is formed in the receptacle chamber so that the deformation zone is deformable into the annular gap when a lateral force is applied to the insulating body.

3. The plug connector for solder-mounting on a circuit board according to claim 1, wherein the longitudinal slots are significantly wider than the transverse slots.

4. The plug connector for solder-mounting on a circuit board according to claim 1, wherein the longitudinal slots staggered relative to each other in the axial direction and are arranged one directly above the other.

5. The plug connector for solder-mounting on a circuit board according to claim 1, wherein the transverse slots are each staggered rotation-symmetrically relative to each other in the circumferential direction of the deformation zone.

6. The plug connector for solder-mounting on a circuit board according to claim 1, wherein at least the deformation zone of the at least one plug contact comprises plastically deformable material.

7. The plug connector for solder-mounting on a circuit board according to claim 1, wherein the at least one oblong electrical plug contact consists of a milled part, a turned part, or a rolled stamped-and-bent part.

8. The electrical plug connector arrangement with at least two oblong electrical plug connectors for mounting on a circuit board by means of soldering according to claim 1 that are soldered to a circuit board.

* * * * *